US007911148B2

(12) United States Patent
Fischer et al.

(10) Patent No.: US 7,911,148 B2
(45) Date of Patent: Mar. 22, 2011

(54) CIRCUIT ARRANGEMENT FOR OPERATING A DISCHARGE LAMP HAVING TEMPERATURE COMPENSATION

(75) Inventors: Klaus Fischer, Friedberg (DE); Josef Kreittmayr, Bobingen (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 330 days.

(21) Appl. No.: 11/921,470

(22) PCT Filed: May 31, 2006

(86) PCT No.: PCT/DE2006/000932

§ 371 (c)(1),
(2), (4) Date: Dec. 3, 2007

(87) PCT Pub. No.: WO2006/128435

PCT Pub. Date: Dec. 7, 2006

(65) Prior Publication Data

US 2009/0121645 A1 May 14, 2009

(30) Foreign Application Priority Data

Jun. 1, 2005 (DE) ..... 10 2005 025 154

(51) Int. Cl.
*H05B 37/02* (2006.01)

(52) U.S. Cl. ..... 315/219; 315/224; 315/225; 315/226

(58) Field of Classification Search ..... 315/112, 315/117, 209 R, 224, 225, 226, 209 T, 209 CD, 315/219, 307

See application file for complete search history.

(56) References Cited

U.S. PATENT DOCUMENTS

| | | | | |
|---|---|---|---|---|
| 3,543,186 | A * | 11/1970 | Flaig | 331/116 R |
| 4,647,817 | A * | 3/1987 | Fahnrich et al. | 315/104 |
| 5,610,479 | A * | 3/1997 | Schmitt | 315/226 |
| 5,677,601 | A * | 10/1997 | Zuchtriegel | 315/209 R |
| 5,925,984 | A * | 7/1999 | Fischer et al. | 315/219 |
| 6,157,142 | A * | 12/2000 | Moisin | 315/307 |
| 6,246,173 | B1 * | 6/2001 | Fischer et al. | 331/117 FE |

FOREIGN PATENT DOCUMENTS

| | | |
|---|---|---|
| DE | 10 2004 007006 | 8/2005 |
| EP | 0 530 603 | 3/1993 |
| EP | 0 781 077 | 6/1997 |
| EP | 0 848 580 | 6/1998 |
| WO | WO 90/05992 | 5/1990 |

* cited by examiner

*Primary Examiner* — Thuy Vinh Tran

(57) ABSTRACT

The invention relates to a circuit arrangement which is used to operate a low pressure discharge lamp (EL), wherein the discharge lamp receives power. Said circuit arrangement is embodied in such a manner that power-determination components (C2*a*, L2*a*) of the circuit arrangement are embodied in a temperature-dependent manner such that the power consumption of the lamp is limited when the temperature rises. Capacitors (C2*a*) and throttles (L2*a*) can be embodied in a temperature-dependent manner in a control circuit (AS) of the circuit arrangement.

4 Claims, 3 Drawing Sheets

CIRCUIT ARRANGEMENT FOR OPERATING A DISCHARGE LAMP HAVING TEMPERATURE COMPENSATION

TECHNICAL FIELD

The invention relates to a circuit arrangement for operating a discharge lamp.

In low-pressure discharge lamps there is an optimum operating point which is defined approximately by the vapor pressure in the discharge lamp which is optimal for gas discharge. This optimal vapor pressure is set given a specific ambient temperature of the lamp and a specific lamp current. The operating voltage then reaches its maximum. At higher (and lower) ambient temperatures the operating voltage drops if the lamp current is kept constant.

PRIOR ART

In the conventional electronic ballast with a circuit arrangement for operating a low-pressure discharge lamp, there is no active regulation of the lamp power independently of the input voltage. In particular, given a system undervoltage the lamp has a lower power consumption and a lower luminous flux, but given a system overvoltage it has a higher power consumption and a higher luminous flux than during operation on the system rated voltage. Since the power consumption of the lamp is not regulated, in the event of the thermally induced change in the operating voltage mentioned above, the output current of the electrical ballast changes. An increased output current in turn results in a rise in temperature of the lamp and therefore in a further decrease in the operating voltage. This direct feedback increases the effect of the operating voltage decrease given an increasing ambient temperature.

An increasing ambient temperature therefore brings about an increase in the currents in the lamp or in the circuit arrangement, which results in increased losses and therefore in further heating of the component parts of the electrical ballast. Thermal overloads of the system or of individual component parts may result.

In accordance with the present prior art, component parts would need to be used for the circuit arrangement which withstand the thermal loading even in the worst case scenario, for example in the event of operation on an overvoltage or a high ambient temperature. Primarily in the case of transistors and capacitors, this results in higher costs for component parts.

DESCRIPTION OF THE INVENTION

The object of the present invention is to improve a circuit arrangement for operating a low-pressure discharge lamp of the type mentioned above in such a way that thermal overloads of the component parts of the lamp are prevented with sufficient reliability. In particular it should be possible to use cost-effective component parts.

This object is achieved in accordance with the characterizing part of patent claim 1.

Accordingly, power-determining component parts of the circuit arrangement are designed to be temperature-dependent in such a way that, when the temperature rises, the power consumption of the lamp is limited.

In order to achieve the desired effect, it is possible in the case of inductors to use, for example, a ferrite material with a low Curie temperature; a ceramic material with temperature-dependent dielectric constant can be used for ceramic capacitances.

Power-determining component parts can in particular be those component parts which have an influence on the operating frequency at which the lamp is operated, as a result of which the current applied to the lamp is influenced.

By way of example, a circuit in accordance with EP 0 781 077 B1 or else in accordance with EP 0 530 603 B1 is mentioned in this regard.

The circuit in accordance with EP 0 781 077 B1 is a circuit arrangement for operating a discharge lamp, in particular a low-pressure discharge lamp, with a load circuit, which has at least one current-limiting resonant inductance and at least one capacitor, and with a freely oscillating inverter, which is in the form of a half-bridge or full-bridge circuit with at least two switching elements. The circuit arrangement furthermore has a drive circuit for driving the switching elements, which has an LC parallel resonant circuit, which comprises a capacitance and an inductance, which discharges this capacitance.

Preferably, the LC parallel resonant circuit is in parallel with a branch which forms the switching path between the control and reference electrodes of a switching element, the current-limiting resonant inductance of the load circuit having an auxiliary winding, which is DC-connected to the LC parallel resonant circuit via a resistor.

It is possible for both the capacitance and the inductance of the LC parallel resonant circuit to be designed to be temperature-dependent. Either a temperature-dependent capacitor can be used for the capacitance or a temperature-dependent inductor can be used for the inductance or both.

In a preferred embodiment, not all of the capacitance or inductance is designed to be temperature-dependent. The capacitance may comprise two capacitors, of which one capacitor is designed to be temperature-independent, and the second is designed to be temperature-dependent. The same is possible in the case of the inductor; two inductors can be provided for implementing the inductance, of which one inductor is designed to be temperature-independent and the other is designed to be temperature-dependent.

The components are each in series with one another.

Owing to the temperature-dependent capacitance or inductance, the frequency of the LC parallel resonant circuit changes in a way which is dependent on the temperature. Correspondingly, the driving of the overall circuit is temperature-dependent, and the operating frequency of the circuit arrangement increases with the temperature, and the currents in the component parts of the circuit arrangement become lower, the current in the lamp becomes lower and the thermal loading of the system is limited.

The circuit arrangement in accordance with EP 0 530 603 B1 is a circuit arrangement for operating a discharge lamp, in particular a low-pressure discharge lamp, with a load circuit, which has at least one current-limiting resonant inductance and at least one capacitor, and with a freely oscillating inverter, which is in the form of a half-bridge circuit with at least two switching elements, and with a drive circuit for driving the switching elements, the drive circuit having an RC element. The resistor of the RC element is in this case the one which is DC-connected to an auxiliary winding of the current-limiting resonant inductance of the load circuit.

In this case, the RC element likewise influences the operating frequency with its low-pass response, so that, in this case, too, the capacitance can be designed to be temperature-dependent. Otherwise it is possible to provide two capacitors in series, of which one is designed to be temperature-independent and the other is designed to be temperature-dependent.

That which has been said above applies not only to those embodiments from EP 0 781 077 B1 and EP 0 530 603 B1 with in each case one LC parallel resonant circuit or an RC element, but also to those embodiments which are disclosed in these specifications in which two separate drive circuits are realized for the half-bridge transistors. In this case, the elements in both drive circuits can be designed to be temperature-dependent. However, it is necessary to ensure a sufficiently synchronous temperature response of the two drive circuits in order to prevent simultaneous switching-on of the two half-bridge transistors.

BRIEF DESCRIPTION OF THE DRAWINGS

The invention will be explained in more detail below with reference to a plurality of exemplary embodiments. In the drawing.

PREFERRED EMBODIMENT OF THE INVENTION

Figure 1:
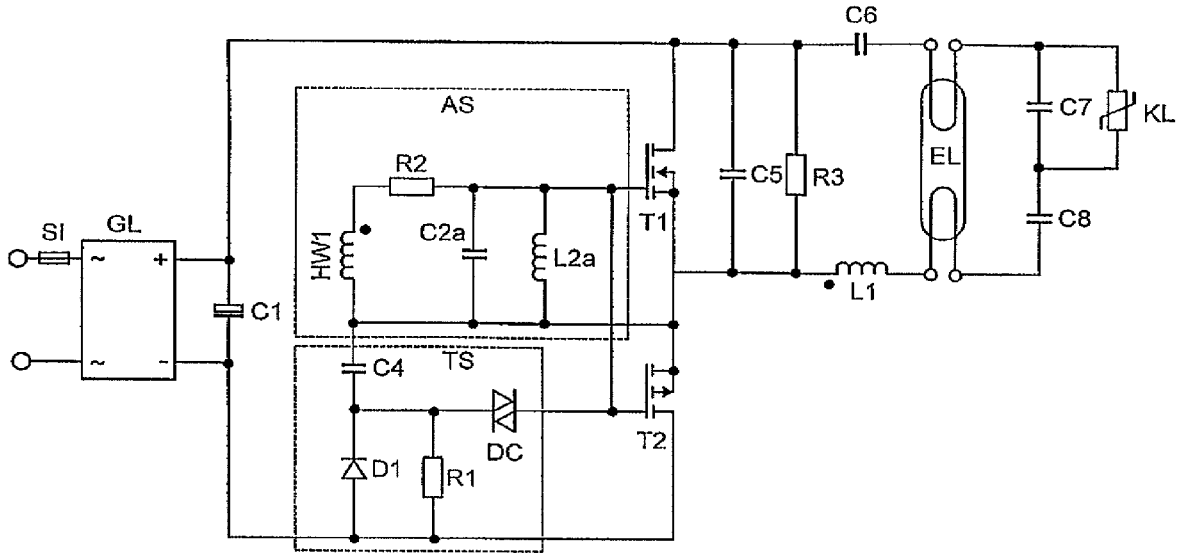
FIG 1 (PRIOR ART)
FIG. 1 shows a circuit arrangement for operating a low-pressure discharge lamp in accordance with EP 0 781 077 B1, in which the present invention can be implemented.

The circuit arrangement illustrated in FIG. 1 for operating a low-pressure discharge lamp EL is known from EP 0 781 077 B1. In this case, it is a half-bridge arrangement with two transistors T1 and T2, which are controlled by a common drive circuit AS. This drive circuit comprises a secondary winding HW1 on an inductor L1, which limits the lamp current and excites a parallel resonant circuit C2*a*, L2*a* via a resistor R2. The AC voltage, which is applied to the control inputs of the complementary half-bridge transistors by this parallel resonant circuit, results in the two transistors T1 and T2 switching on alternately, as a result of which the DC voltage present at the capacitor C1 is converted in a known manner into a high-frequency AC voltage for supplying the load circuit (comprising C5, C6, C7, C8, KL, EL, R3 and L1).

The LC parallel resonant circuit comprising C2*a* and L2*a* is therefore DC-connected to the auxiliary winding HW1 via the resistor R2 for the purpose of injecting energy from the load circuit.

The element denoted here by TS does not need to be described in any more detail. It is a runup circuit which is used for starting the self-oscillating oscillation.

The operating frequency at which the resonant circuit is fed is strongly dependent on the natural resonant frequency of the resonant circuit comprising C2*a* and L2*a*. The component parts C2*a* and L2*a* are therefore power-determining component parts because the natural resonant frequency influences the current applied to the lamp EL via the operating frequency of the circuit arrangement.

According to the invention, the capacitance C2*a* or the inductance L2*a* is now designed to be temperature-dependent. As the temperature increases, in this case the capacitance or the inductance should decrease and thus the natural resonant frequency of the parallel resonant circuit should increase. As a result, the operating frequency of the circuit arrangement and therefore the AC resistance of the lamp inductor L1 increases as the temperature increases. The currents in the component parts of the circuit arrangement and in the lamp thus become lower, and the thermal loading of the system is limited.

Figure 2:
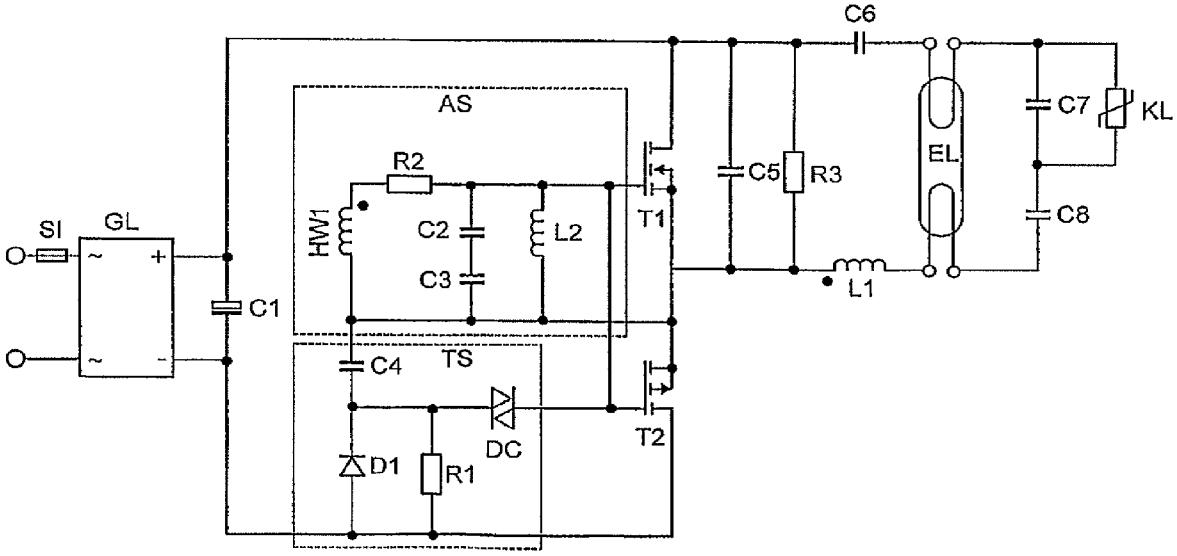
FIG. 2 shows a first modification of the circuit arrangement shown in FIG. 1.

In the case of conventional components, the variation of the capacitance or the inductance in the permissible temperature range may possibly be too great. In order to ensure correct functioning of the circuit arrangement, this being at all temperatures, an embodiment in accordance with FIG. 2 is proposed. In this case, only the capacitance is designed to be temperature-dependent. The capacitance comprises two capacitors C2 and C3, of which the capacitor C2 has a temperature-independent value, which approximately corresponds to the maximum value of the capacitance desired at a minimum temperature. The second capacitor C3 should have a considerably higher value than the capacitor C2 given a relatively low temperature, with the result that the total capacitance of the series circuit comprising C2 and C3 is substantially defined by the size of C2. As the temperature increases, the capacitance of C3 should become significantly lower, as a result of which the total capacitance of the series circuit decreases. At a maximum temperature, the capacitance should reach a minimum value.

Figure 4:
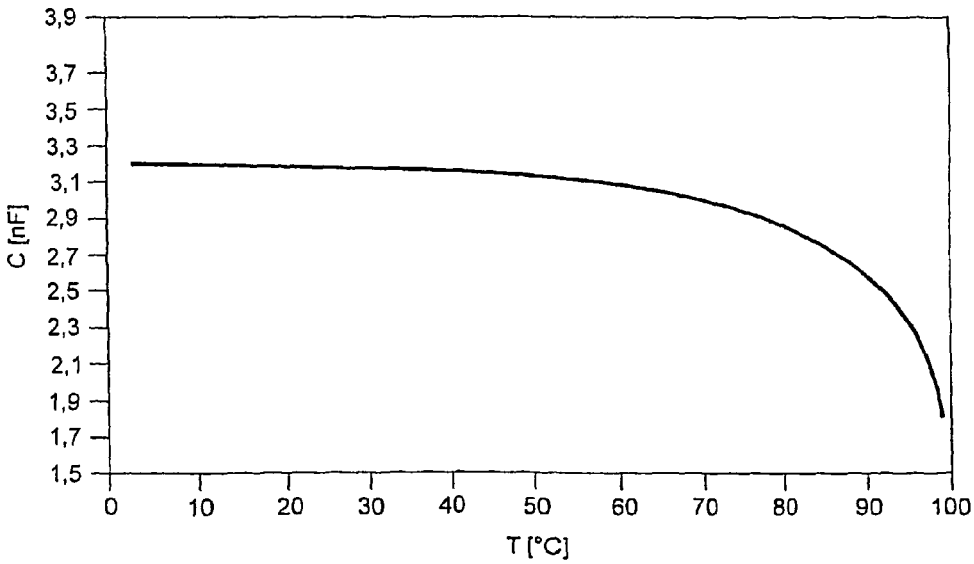
FIG. 4 shows the temperature response of a capacitance, which comprises two series-connected capacitors, of which one is approximately linearly temperature-dependent.

The response of the capacitance of the series circuit comprising C2 and C3 is illustrated in FIG. 4. This shows, by way of example, the total capacitance of a parallel resonant circuit as shown in FIG. 2, in which C2=3.3 nF and C3=100 nF at 10° Celsius. The capacitance of the capacitor C3 is assumed to decrease linearly and up to approximately 100° Celsius (in the model these are only approximations) assumes a value of likewise 3.3 nF. At 100° Celsius, the total capacitance therefore decreases almost to half the value at 10° Celsius.

Figure 5:
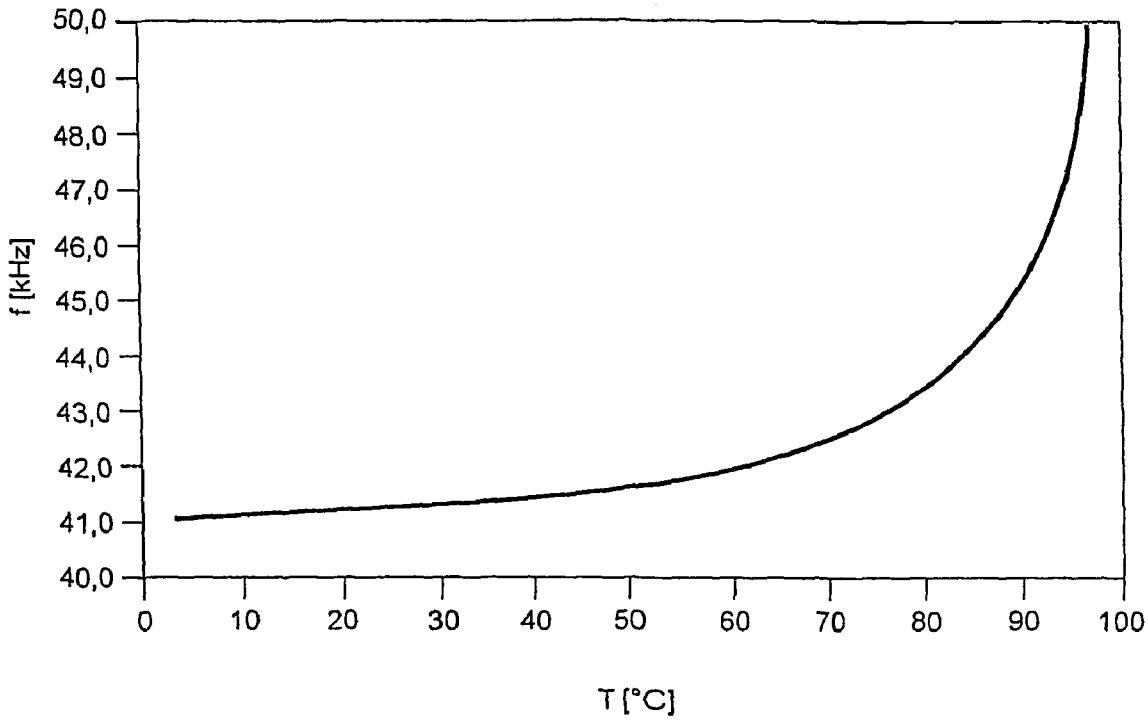
FIG. 5 shows the response of the operating frequency, which is determined by the capacitance shown in FIG. 4.

FIG. 5 illustrates the dependence of the natural resonant frequency of the parallel resonant circuit of the above-mentioned type on the temperature of the capacitor C3.

In particular it can clearly be seen in FIG. 5 that the temperature only has a notable influence on the resonant frequency above approximately 50° to 60° Celsius. As the temperature approaches 100° Celsius, where it is particularly critical, the change in the resonant frequency is particularly noticeable.

The current in the discharge lamp is therefore severely reduced between 50° and 100° Celsius, with the result that further heating of component parts cannot result.

Figure 3:
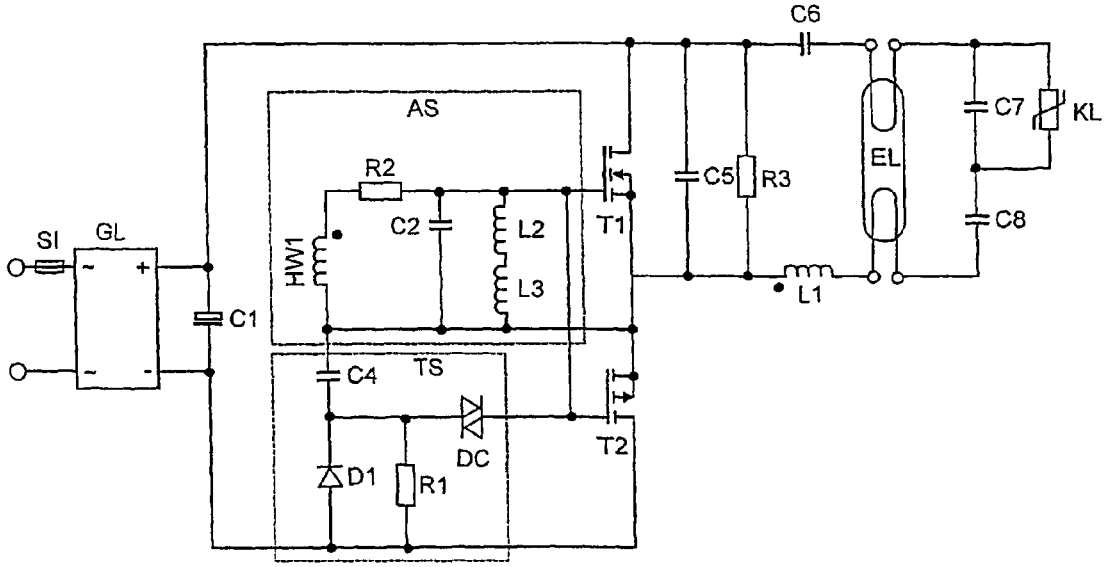
FIG. 3 shows a second modification of the circuit arrangement shown in FIG. 1.

As an alternative to the measure illustrated in FIG. 2 that two capacitors are provided for implementing the capacitance C2*a*, of which one is temperature-dependent, the inductance L2*a* can also be designed in such a way that it comprises two inductances L2 and L3 in series, as is illustrated in FIG. 3. One of the inductors, L2, has a temperature-independent value, which approximately corresponds to the minimum value desired at a maximum temperature. The second inductor L3 is intended to have, at a low temperature, such a value at which the total inductance of the series circuit comprising L2 and L3 corresponds to the value which is required for normal temperatures. As the temperature increases, the inductance of L3 should become significantly lower until it reaches a minimum value at a maximum temperature.

The embodiments shown in FIG. 2 and FIG. 3 can also be combined with one another, i.e. provision may also be made for both the capacitance C2*a* and the inductance L2*a* to each comprise temperature-dependent elements in series with temperature-independent elements.

The use of the circuit from EP 0 781 077 B1 merely serves as an example and is used for explaining what is meant by power-determining component part. The circuit arrangement in accordance with EP 0 530 603 B1 is substantially identical to the circuit arrangement illustrated in FIG. 1 from EP 0 781 077 B1, the inductor L2*a* being omitted in the drive circuit. Instead of an LC parallel resonant circuit, there is an RC element, whose low-pass properties have a similar influence on the operating frequency. Correspondingly, with this circuit the invention also provides for the capacitance from the drive circuit to be designed to be temperature-dependent. This can in particular also take place using two capacitors which are connected in series, of which one is strongly temperature-dependent and the other is temperature-independent.

The power-determining component part within the meaning of the invention is not understood as being any component part which in a marginal way has an influence on the power, but component parts which are suitable for noticeably influencing the power consumption of the lamp given a temperature-dependent design in order to thus bring about a visible effect in relation to the temperature control.

The invention claimed is:

1. A circuit arrangement for operating a discharge lamp, in which the discharge lamp consumes a power, the circuit arrangement comprising a load circuit, which has at least one current-limiting resonant inductance and at least one capacitor and a freely oscillating inverter, which is in the form of a half-bridge or full-bridge circuit with at least two switching elements, and a drive circuit for driving the at least two switching elements;

said drive circuit comprising an LC parallel resonant circuit which has a capacitance and an inductance discharging said capacitance, and wherein said capacitance or said inductance of said LC parallel resonant circuit is designed to be temperature-dependent in such a way that when the temperature rises, the power consumption of the lamp is limited.

2. The circuit arrangement as claimed in claim 1, wherein a) the capacitance of the LC parallel resonant circuit is formed from two capacitors, which are connected in series, the first capacitor being designed to be temperature-independent, and the second capacitor being designed to be temperature-dependent, or b) the inductance of the LC parallel resonant circuit is formed from two series-connected inductors of which the first inductor is designed to be temperature-independent, and the second inductor is designed to be temperature-dependent.

3. The circuit arrangement for operating a discharge lamp as claimed in claim 1, the drive circuit further comprising an RC element, which has a capacitance, wherein the capacitance of the RC element is designed to be temperature-dependent.

4. The circuit arrangement for operating a discharge lamp as claimed in claim 3, wherein the capacitance of the RC element is formed from two series-connected capacitors, of which the first capacitor is designed to be temperature-independent, and the second capacitor is designed to be temperature-dependent.

* * * * *